US006863617B2

(12) United States Patent
Park

(10) Patent No.: US 6,863,617 B2
(45) Date of Patent: Mar. 8, 2005

(54) GOLF PUTTER

(76) Inventor: Sam Park, 8900 Rainbow Ridge Dr., Las Vegas, NV (US) 89117

( * ) Notice: Subject to any disclaimer, the term of this patent is extended or adjusted under 35 U.S.C. 154(b) by 0 days.

(21) Appl. No.: 10/646,587

(22) Filed: Aug. 22, 2003

(65) Prior Publication Data

US 2004/0166950 A1 Aug. 26, 2004

Related U.S. Application Data

(63) Continuation-in-part of application No. 10/373,502, filed on Feb. 24, 2003.

(51) Int. Cl.[7] ..... A63B 69/36

(52) U.S. Cl. ..... 473/226; 473/230; 473/242; 473/251; 473/257

(58) Field of Search ..... 473/226, 242, 473/235, 236, 230, 286, 278, 251, 219, 324, 257, 249, 409

(56) References Cited

U.S. PATENT DOCUMENTS 2,709,595 A * 5/1955 De Vries ..... 473/200
3,632,112 A * 1/1972 Jacobs ..... 473/286
3,708,172 A * 1/1973 Rango ..... 473/249
4,002,343 A * 1/1977 Eckert ..... 473/251
4,248,430 A * 2/1981 Kepler ..... 473/285
4,284,276 A * 8/1981 Worst ..... 473/383
4,580,784 A * 4/1986 Brill ..... 473/286
4,756,535 A * 7/1988 Bradley ..... 473/230
4,846,477 A * 7/1989 Phelan ..... 473/330
5,417,426 A * 5/1995 Bayer ..... 473/285
5,476,262 A * 12/1995 Bandiero ..... 473/309
D402,724 S * 12/1998 Minami ..... D21/743
6,422,949 B1 * 7/2002 Byrne et al. ..... 473/200
6,435,975 B2 * 8/2002 Middleton ..... 473/231
6,702,688 B2 * 3/2004 Hale ..... 473/226

* cited by examiner

*Primary Examiner*—Sebastiano Passaniti
(74) *Attorney, Agent, or Firm*—Jerry H. Noh

(57) ABSTRACT

A putter for improving a golfer's putting game having a shaft attached to a head having a hitting surface, top surface, and a bottom surface. The head having a front portion and a rearwardly extending portion. The rearwardly extending portion having a pair of side walls. An aperture being defined on the bottom surface of the head. A ball disposed within the head and protruding through both the apertures of said top surface and bottom surface. The ball being both removeable and mounted to roll only in the direction perpendicular to the hitting surface.

11 Claims, 5 Drawing Sheets

FIG. 4
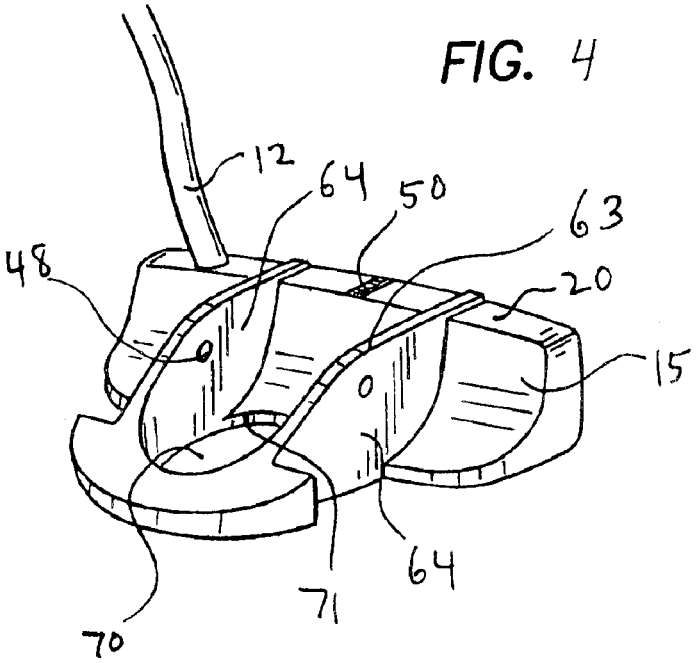
FIG. 5
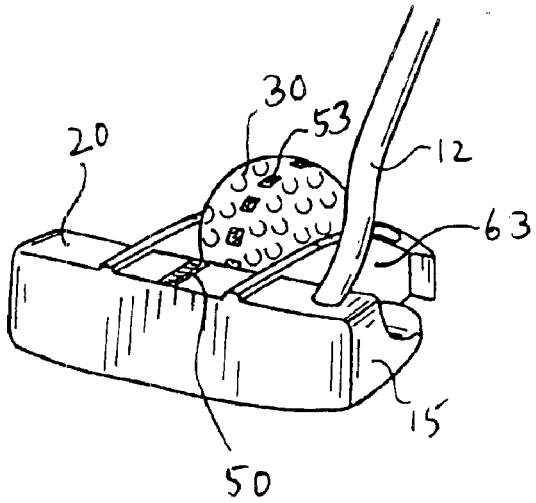
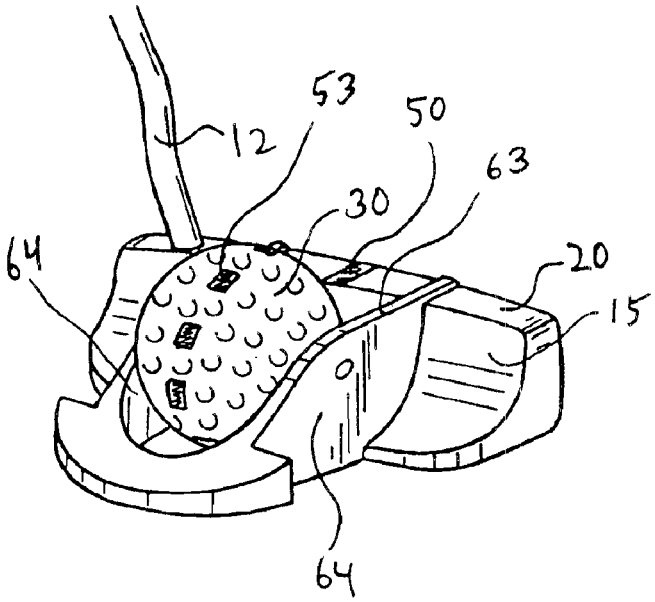
FIG. 6

FIG. 10
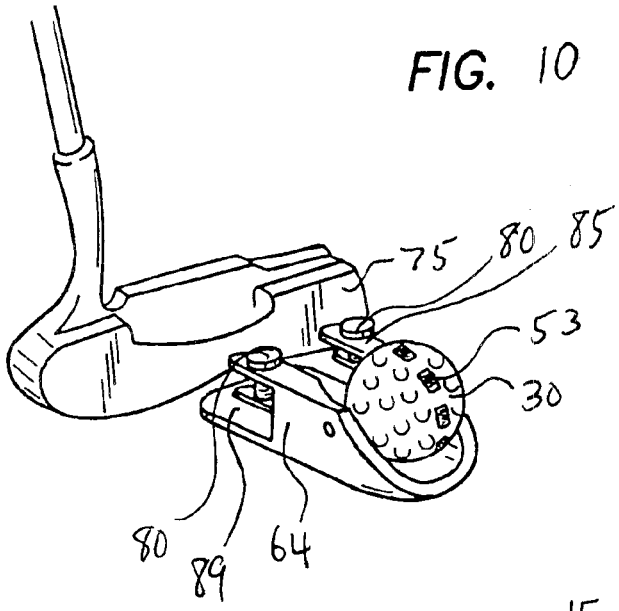
FIG. 11
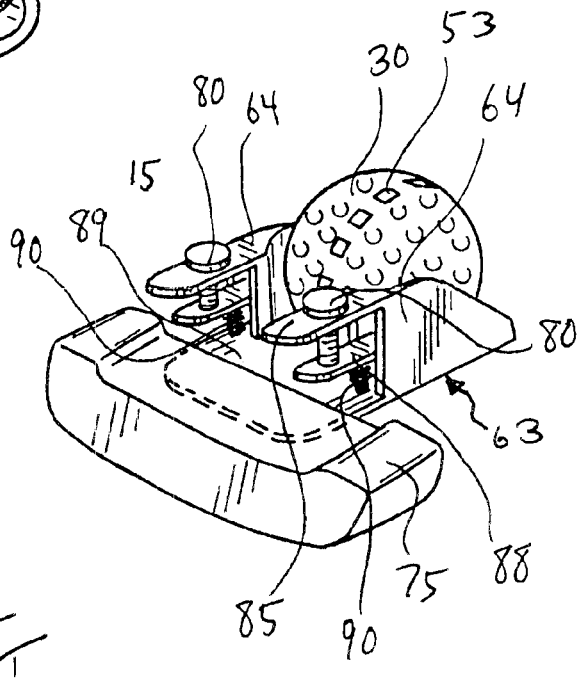
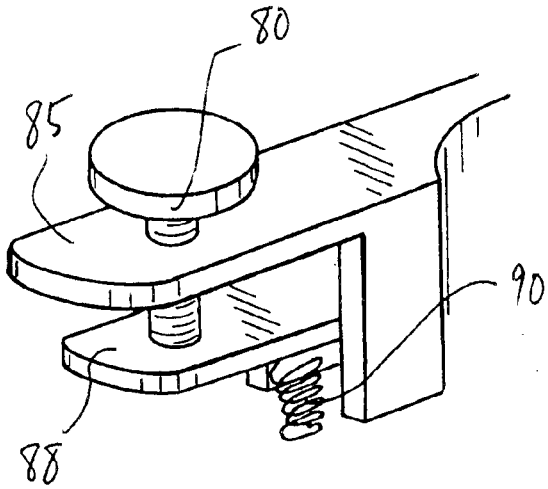
FIG. 12

GOLF PUTTER

This application is a continuation in part of application Ser. No. 10/373,502 previously filed on Feb. 24, 2003.

BACKGROUND OF THE INVENTION

I. Field of the Invention

This invention pertains to golf clubs. More specifically, the invention concerns a golf putter having a guide ball for improving a golfer's putting stroke.

II. Description of the Prior Art

Golf is a popular sport and form of recreation enjoyed by many individuals. Throughout the years many technical advancements in the golf ball, golf club, and golf course have been made to improve golf scores. The golf putter has seen significant advancement since it plays a vital role in a golfer's performance.

Putters play a key role in improving one's score. Most conventional putters have a shaft attaching to a putter head with a flat hitting surface for striking a ball. Most putters have the flat face positioned so that the golfer swings from side to side with his body relatively parallel to the "line of sight", which is the line from the ball to a hole. The common design of putters have a bottom surface facing the ground when in use. During a putting stroke, it is desirable for the bottom surface of the putter to have little to no contact with the ground so as to eliminate potential for interference. Thus in a desired putting stroke, the user typically raises the putter slightly so that the hitting surface does not touch the putting surface usually referred to as the green. Many different types of golf putters have been developed for improving one's putting stroke.

U.S. Pat. No. 5,409,220 issued to Lombardo teaches a putter with an advantageously angled and constructed shaft. Another golf putter is U.S. Pat. No. 4,688,799 issued to Johnson which teaches a putter having a rotatable circular roller mounted on either the toe or the heel of the golf club. The roller prevents friction with the ground by raising the head so that the hitting surface does not touch the putting green in a stroke. A disadvantage, however, is that the single roller does not improve the straight motion of one's putting stroke.

Another putter is U.S. Pat. No. 3,319,964 issued to Steinburg. Steinburg teaches a practice putter having an axle extending across the head parallel to the hitting surface and having a rotatable wheel on each end of the axle. The wheel raises the hitting surface above the green and allows straight putting strokes as long as the stroke follows the direction of the spinning wheels. A disadvantage is that there is no indicator means to determine whether the wheels are spinning in all speeds of the putting stroke. The user must depend on looking at the wheel to see if it is spinning which can detract from his focus on the golf ball and line of sight to the hole.

None of the prior art teaches an improved putter as taught by the present invention.

Thus, it is a primary objective of the present invention to provide a golf putter which can improve a golfer's ability to develop a straight and smooth putting stroke. It is a further objective to provide a golf putter which can improve a golfer's ability to maintain a consistent desired speed of the putting stroke.

SUMMARY OF THE INVENTION

The present invention is a putter for improving a golfer's putting game. The putter has a conventional shaft connecting to an improved head. The head has an essentially flat hitting surface for striking a golf ball, a top surface, and a bottom surface. A portion of the head extends rearward and has a cavity for housing a guide ball therein. A top plate forms part of the top surface of the head and is removeably attached to the head. The top plate can be opened and closed for insertion and removal of the ball into the cavity. The ball is of the same size and dimension as a conventional golf ball. A top aperture is formed through the top plate leading into the cavity, and a bottom aperture is defined through the bottom surface also leading into the cavity. The ball is rotatably mounted on an axle within the cavity, and the ball is visible from the top and the bottom as it protrudes partially outward through both the top aperture and the bottom aperture. The ball rolls back and forth in the direction perpendicular to the hitting surface.

Also, a sight line is marked on the top surface of the head perpendicular to the hitting surface, and a broken line extends around the ball in a predetermined manner so that the broken line is in-line with the sight line of the top surface. When the ball is rolling, the broken line should appear as a solid line being in-line with the sight line. The sight line assists the golfer to develop a straight putting swing when hitting a target ball. The putter further assists the golfer to develop a controlled putting stroke speed as the ball will spin so long as it is in contact with the putting surface and moving within a predetermined speed limit.

BRIEF DESCRIPTION OF THE DRAWING

With the above and additional objects and advantages in view, as will hereinafter appear, this invention comprises the devices, combinations and arrangements of parts hereinafter described, by way of example, and illustrated in the accompanying drawings of a preferred embodiment in which:

FIG. 4 is a perspective view of the head and a portion of the shaft of a second embodiment of the present invention shown with the ball removed;

FIG. 5 is a front perspective view of the second embodiment;

FIG. 6 is a back perspective view of the second embodiment;

FIG. 10 is a detached back view of the third embodiment of the present invention;

FIG. 11 is a detached top view of the third embodiment of the present invention; and, FIG. 12 is an isolated enlarged view of a portion of the third embodiment of the present invention.

DESCRIPTION OF THE PREFERRED EMBODIMENT

Figure 1:
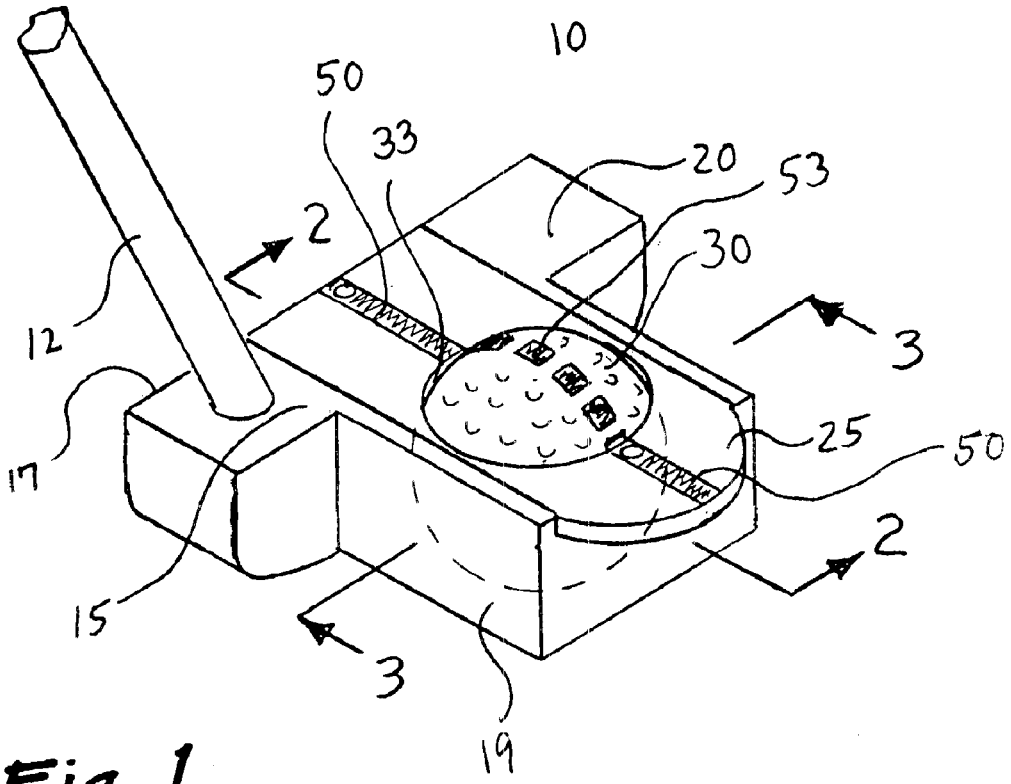
FIG. 1 is a top perspective isolated view of the head and a portion of the shaft of the present invention.

FIG. 1 shows the putter 10 of the present invention. The putter 10 comprises a shaft 12 connecting to a head 15. The head 15 has an essentially flat hitting surface 17 for striking a golf ball, a top surface 20, and a bottom surface 22. A top plate 25 forms part of the top surface 20 of the head 15 and is removeably attached to the head 15. The head 15 has a rearwardly extending portion 19. The head 15 has a cavity defined therein for housing a guide ball 30. The ball 30 is of the same size and dimension as a conventional golf ball. In the embodiment shown, the ball 30 is a conventional golf ball having all the dimples of the same. The conventional golf ball currently has a minimum diameter of approximately 1.68 inches in the United States. The conventional golf ball can be any golf ball having a minimum diameter accepted by the United States Golf Association or another agency regulating golf ball size. Furthermore, in the embodiment shown, the cavity is located within the rearwardly extending portion 19 of the head 15.

A top aperture 33 is formed through the top plate 25 leading into the cavity, and a bottom aperture 35 is defined through the bottom surface 22 also leading into the cavity. The ball 30 is rotatably mounted within the cavity and protrudes partially outward through both the top aperture 33 and the bottom aperture 35. In this manner, the ball 30 is visible from both above and below the head 15. The ball 30 protrudes sufficiently from the bottom aperture 35 so that when the ball 35 is rolling on a putting surface, the bottom surface 22 of the head 15 is elevated above the putting surface. In the embodiment illustrated in FIGS. 1 to 3, a bore 38 extends through the ball 30, and a ringed bearing 40 is placed at each end of the bore 38. The ball 30 is mounted on a spring loaded axle 45 extending through the bore 38 and the bearings 40. Each end of the axle 45 is rounded and mounts into a corresponding indentation 48 formed into the wall of the head 15 inside the cavity. In this manner, the ball 30 rolls back and forth only in the direction perpendicular to the hitting surface 17. To remove the ball 30, the user simply removes the top plate 25 and pulls on the ball 30 causing the axle 45 to press inward and out from the corresponding indentations 48. To reinstall the ball 30, the user simply opens the top plate 25, pushes the axle 45 inward and into the corresponding indentations 48, and closes the top plate 25.

Also, the head 15 has a sight line 50 extending across the top surface 20 of the head perpendicular to the hitting surface 17. In the embodiment shown, the sight line 50 extends across the top plate 25. A broken line 53 extends around the ball 30 in a predetermined manner so that the broken line 53 is in-line with the sight line 50 of the top surface 20. When the ball 30 is rolling, the broken line 53 should appear as a solid line that is in-line with the sight line 50. The sight line 50 assists the golfer to develop a straight putting swing when hitting a target golf ball. In the desired putting motion, the sight line 50 should move in a straight direction.

In an alternative second embodiment shown in FIGS. 4 to 7, the putter 10 comprises a shaft 12 connected to a head 15. The head 15 has a hitting surface 17, and a rearwardly extending portion 63. A pair of side walls 64 form part of the rearwardly extending portion 63. The ball 30 is rotatably mounted between the pair of side walls 64. As in the embodiment illustrated in FIGS. 1 to 3, a bore 38 extends through the ball 30, and a ringed bearing 40 is placed at each end of the bore 38. The ball 30 is mounted on a spring loaded axle 45 extending through the bore 38 and the bearings 40. Each end of the axle 45 is rounded and mounts into a corresponding indentation 48 formed into each side wall 64 of the rearwardly extending portion 63 of the head 15.

Figure 2:
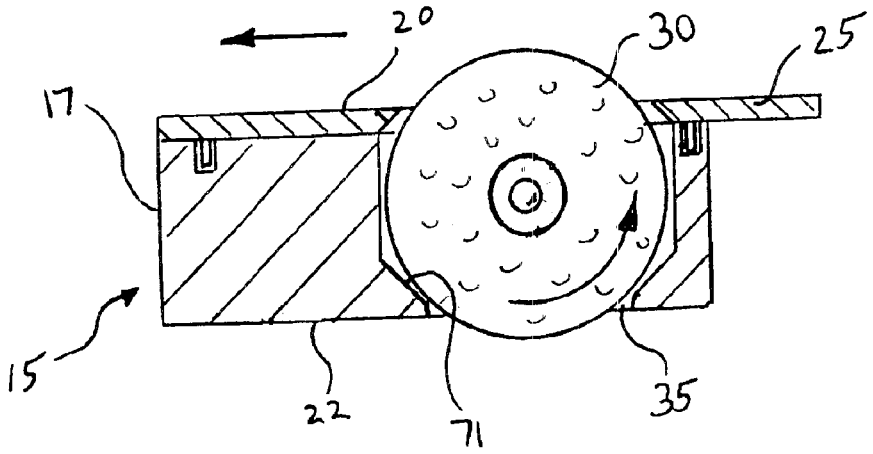
FIG. 2 is a cross-sectional side view of the head cut along the 2—2 line of FIG. 1.
Figure 3:
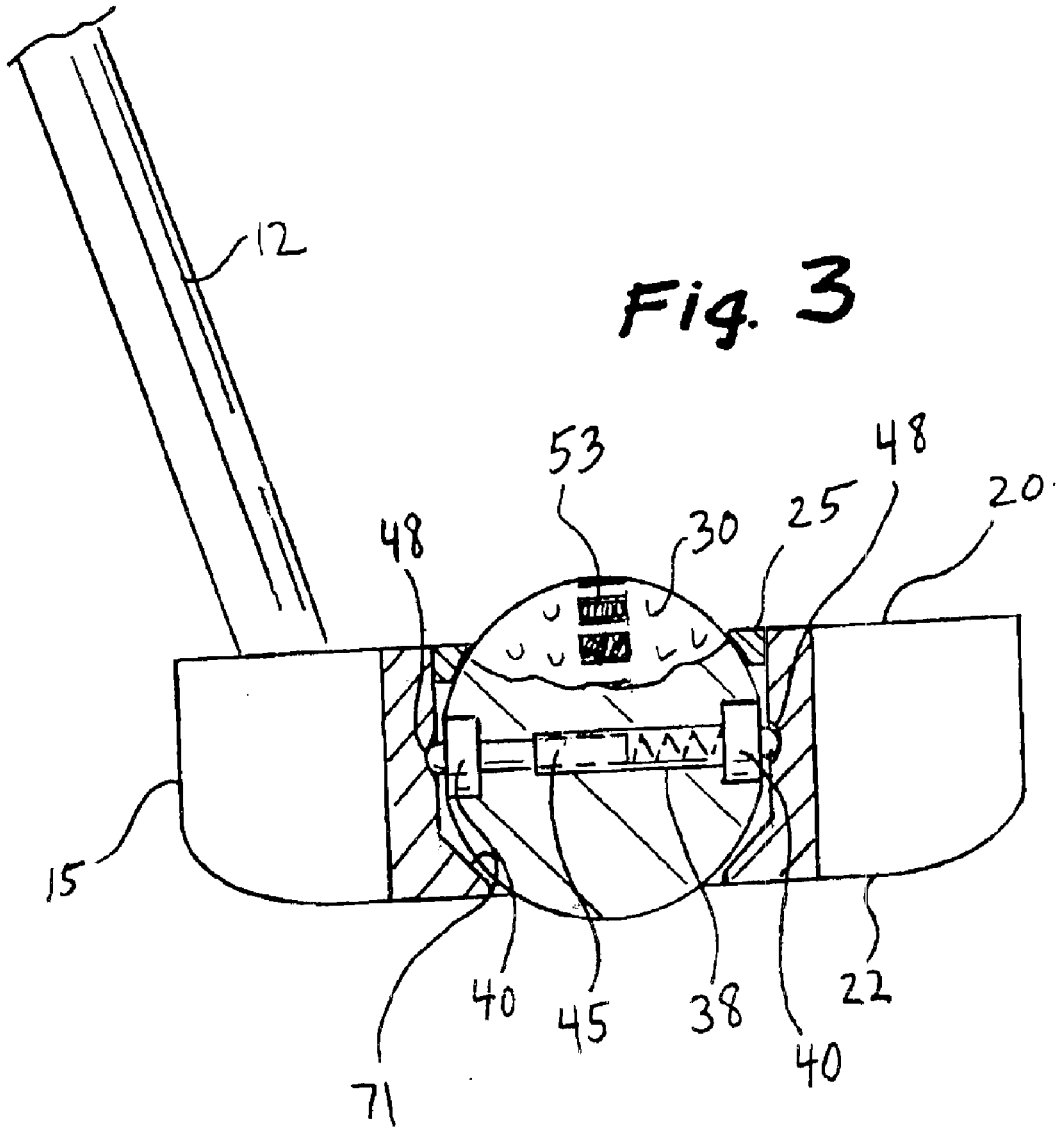
FIG. 3 is a front cross-sectional view of the head cut along the 3—3 line of FIG. 1.
Figure 7:
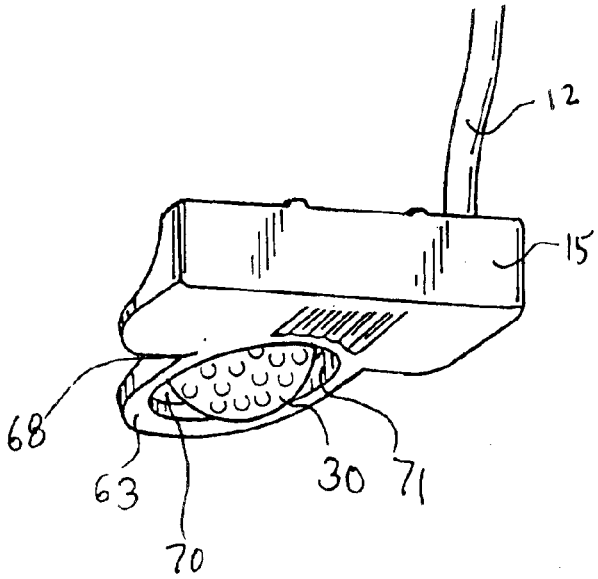
FIG. 7 is a bottom perspective view of the second embodiment.
Figure 8:
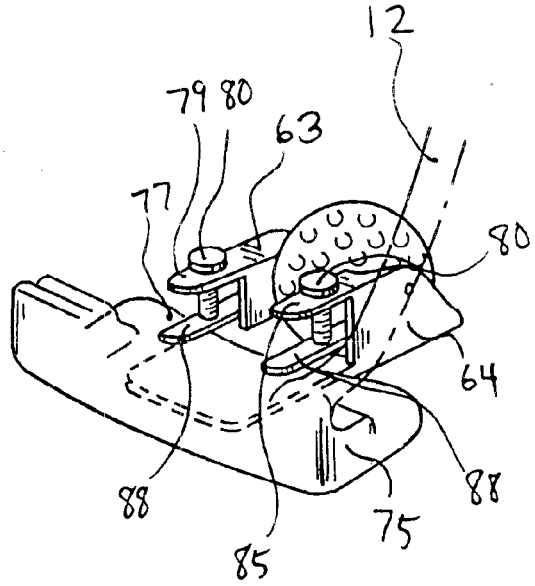
FIG. 8 is a top perspective view of a third embodiment of the present invention.
Figure 9:
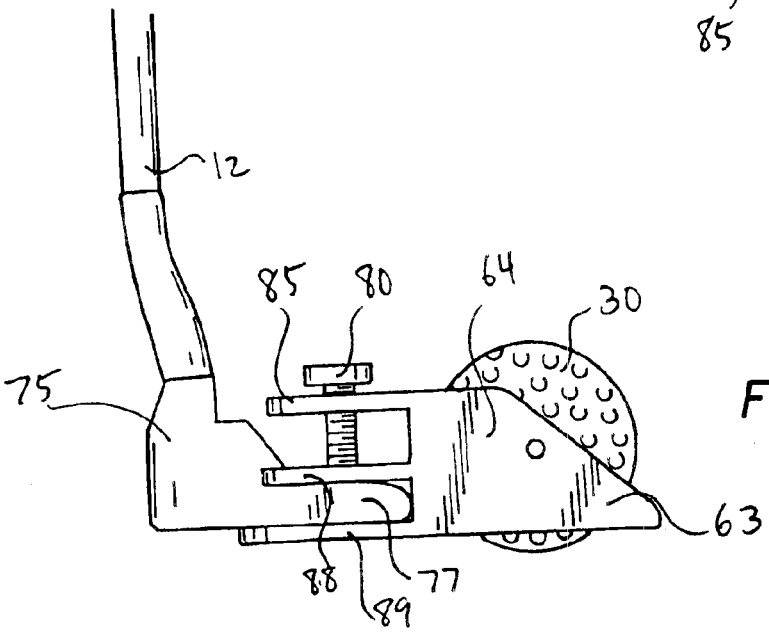
FIG. 9 is a side plan view of the third embodiment of the present invention.

The ball 30 of the second embodiment, as in the embodiment shown in FIGS. 1 to 3, is of the same size and dimension as a conventional golf ball and also has the broken line 53 extending around the ball 30 which is in line with a sight line 50 extending across the top surface 20 of the head 15. In addition, the rearwardly extending portion has a bottom surface 68 having an aperture 70 therethrough. The edge 71 of the bottom surface 68 surrounding the aperture 70 is tapered with a downward slope as found also in the embodiment shown in FIGS. 1 to 3.

In a third embodiment of the present invention as shown in FIGS. 8 to 12, the rearwardly extending portion 63 of the head 15 of the second embodiment is formed to be detachable with a front head portion 75. In this embodiment, the front head portion 75 has an essentially flat rear surface 77 for attachment of the rearwardly extending portion 63 thereto. Each end of the side walls 64 has an attachment assembly 79 for detachable connection to the front head portion 75. In the embodiment shown in FIGS. 8 to 12, the attachment assembly 79 has a threaded pin 80 mounted on a top plate 85 protruding from the side wall 64. In addition each side wall 64 has a bottom plate 88 protruding below the corresponding top plate 85 and pin 80. The pin 80 can be turned in a predetermined direction to attach the rearwardly extending portion 63 to the front head portion 75 as the pin 80 presses firmly against bottom plate 88 to clamp the rear surface 77 of the front head portion 75 between the bottom plate 88 and the protruding bottom surface 89 of the rearwardly extending portion 63. In the embodiment shown in FIGS. 8 to 12, a spring 90 is placed below each bottom plate 88 on the bottom surface 89 biased to urge each corresponding bottom plate 88 upward.

The putter of the present invention assists the golfer in developing an ideal flat, straight, sweeping putting stroke. In use, the right-handed golfer holds the putter and swings the head from right to left in order to strike a target ball. Each putter has a "sweet spot" on the hitting surface. This is the spot usually on the central portion of the hitting surface that the golfer wants to hit the golf ball with in order to produce the most accurate result. In an ideal put, the "sweet spot" makes contact with the golf ball's center of mass. On the putter, the "sweet spot" is centrally located on the hitting surface. To properly use the putter, it is necessary to roll the head across the putting surface on the freely rotating ball. The ball guides the head to move in a straight line. Furthermore, the ball assists the golfer to maintain the head at the proper level above the putting surface. It is necessary for the golfer to have the ball touch the putting surface to cause rotation of the ball in a putting swing. When the ball is touching the putting surface and rotating, the sweet spot of the hitting surface will strike the targeted golf ball. Additionally, the putter helps the user develop a desired putting stroke by controlling the speed of the back stroke (when the head is swung away from the golf ball) and front stroke (when the head is swung toward the golf ball). The ball of the putter only spins within a desired speed limit of the back stroke and front stroke. If the stroke is too fast beyond the predetermined limit, the ball will not spin. The user can know whether the ball is spinning by looking at the broken line on the ball. If the line remains broken, the ball is not spinning. If the ball is spinning, the broken line will appear as a solid line which is in-line with the sight line of the top surface of the head.

When the average golfer properly uses the putter, his putting accuracy should be maximized through good developed habits. Also, by removing the ball from the head, the golfer can use the putter without the assistance of the ball.

While a preferred embodiment of the invention has been described and illustrated for purposes of clarity and example, it should be understood that many changes, substitutions and modifications to the described embodiment will be apparent to those having skill in the art in light of the foregoing disclosure without departing from the scope and spirit of the present invention which is defined by the claim which will follow.

What is claimed is:

1. An improved putter comprising:

a shaft;

a head connected to said shaft, said head having a hitting surface for striking a golf ball, a top surface, and a bottom surface;

said head having a rearwardly extending portion, said rearwardly extending portion having a pair of side walls;

said rearwardly extending portion is detachably connected to said head;

each side wall has an attachment assembly formed thereon for detachable connection to said head;

a bottom aperture defined through said bottom surface of said head;

a ball rotatably disposed within said head, said ball positioned to be viewable from the top and to protrude partially outward through said bottom aperture;

a top plate and a bottom plate protruding from each side wall;

a threaded pin extending through the top plate and between said bottom plate;

said head having an essentially flat rear surface; and, said pin and plates being formed and positioned so that said rearwardly extending portion clamps onto said rear surface of the head as each pin is turned in a predetermined direction.

2. The improved putter as described in claim 1 further comprising a sight line extending across the top surface of the head perpendicular to the hitting surface; and, a broken line extending around said ball, said broken line being in-line with said sight line of said top surface.

3. The improved putter as described in claim 1 wherein the edge of the bottom surface surrounding said aperture formed through said bottom surface is tapered with a downward slope.

4. An improved putter comprising:

a shaft;

a head connected to said shaft, said head having a bottom surface, said head having a front head portion, said front head portion having a hitting surface for striking a golf ball and a top surface;

said head having a rearwardly extending portion extending rearwardly from the front head portion, said rearwardly extending portion having a pair of side walls;

a bottom aperture defined through said bottom surface of said head; and, a ball rotatably disposed within said head, said ball positioned to be viewable from the top and to protrude partially outward through said bottom aperture, said ball being of the same size and dimensions as a golf ball;

a bore extending through said ball;

a bearing disposed on each end of said bore of said ball, said ball being mounted on a spring loaded axle, and, said axle extending through said bore and each of said bearing.

5. The improved putter as described in claim 4 wherein each side wall has an inner surface, an indentation is formed on each inner surface of each side wall, each end of said axle has a rounded surface, and each end of said axle is removeably lodged within a corresponding indentation.

6. The improved putter as described in claim 4 wherein said rearwardly extending portion is detachably connected to said head.

7. The improved putter as described in claim 4 wherein said ball is a golf ball.

8. An improved putter comprising:

a shaft;

a head connected to said shaft, said head having a front portion, said front portion having a hitting surface for striking a golf ball, a top surface, and a rear surface;

said front portion having an substantially flat rear surface;

a detachable rearwardly extending portion connected to the flat rear surface of the front portion, said rearwardly extending portion having a pair of side walls and a bottom surface;

an aperture formed through said bottom surface;

an attachment assembly formed on each side wall for connection of said rearwardly extending portion to said front head portion; and, a ball rotatably disposed between said side walls, said ball being of the same size and dimensions as a golf ball, said ball positioned to be viewable from the top and to protrude partially outward through said bottom aperture;

a top plate and a bottom plate protruding from each side wall;

a threaded pin extending through the top plate and between said bottom plate; and, said pin and plates being formed and positioned so that said rearwardly extending portion clamps onto said rear surface of the head as each pin is turned in a predetermined direction.

9. The improved putter as described in claim 8 wherein said ball is a golf ball.

10. An improved putter comprising:

a shaft;

a head connected to said shaft, said head having a front portion, said front portion having a hitting surface for striking a golf ball, a top surface, and a rear surface;

said front portion having an substantially flat rear surface;

a detachable rearwardly extending portion connected to the flat rear surface of the front portion, said rearwardly extending portion having a pair of side walls and a bottom surface;

an aperture formed through said bottom surface;

an attachment assembly formed on each side wall for connection of said rearwardly extending portion to said front head portion; and, a ball rotatably disposed between said side walls, said ball being of the same size and dimensions as a golf ball, said ball positioned to be viewable from the top and to protrude partially outward through said bottom aperture;

a bore extending through said ball;

a bearing disposed on each end of said bore of said ball, said ball being mounted on a spring loaded axle, said axle extending through said bore and each of said bearing;

each side wall having an inner surface;

an indentation formed on each inner surface of each side wall;

each end of said axle having a rounded surface; and, wherein each end of said axle is removeably lodged within a corresponding indentation.

11. The improved putter as described in claim 10 wherein said ball is a golf ball.

* * * * *